US008257096B2

(12) United States Patent
Matsuoka et al.

(10) Patent No.: US 8,257,096 B2
(45) Date of Patent: Sep. 4, 2012

(54) DEVICE CONNECTOR

(75) Inventors: Hiroyuki Matsuoka, Yokkaichi (JP); Daisuke Nakagawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 98 days.

(21) Appl. No.: 12/942,681

(22) Filed: Nov. 9, 2010

(65) Prior Publication Data

US 2011/0117784 A1 May 19, 2011

(30) Foreign Application Priority Data

Nov. 17, 2009 (JP) ..... 2009-262128

(51) Int. Cl.
*H01R 12/00* (2006.01)

(52) U.S. Cl. ..... 439/76.2; 439/626

(58) Field of Classification Search ..... 439/76.2, 439/626–629

See application file for complete search history.

(56) References Cited

U.S. PATENT DOCUMENTS 5,368,498 A * 11/1994 Matsuoka et al. ..... 439/331
6,276,944 B1 * 8/2001 Klatt ..... 439/76.1
6,402,535 B2 6/2002 Okabe et al.
6,428,353 B2 8/2002 Mochizuki
6,699,069 B2 3/2004 Inoue
7,001,197 B2 * 2/2006 Shirai et al. ..... 439/331
7,572,150 B2 8/2009 Matsuoka
2002/0004326 A1 1/2002 Mochizuki
2002/0016100 A1 2/2002 Okabe et al.
2011/0104924 A1 5/2011 Matsuoka et al.
2011/0117784 A1 5/2011 Matsuoka et al.

* cited by examiner

*Primary Examiner* — Truc Nguyen

(74) *Attorney, Agent, or Firm* — Gerald E. Hespos; Michael H. Porco

(57) ABSTRACT

A device connector is provided with a metal reinforcing plate (30) including an opening (31) for permitting the passage of terminal fittings, a housing main body (10), a flange (11) formed by insert molding using the reinforcing plate (30) and synthetic resin, a device-side housing portion (12) to be accommodated into a connector mounting hole, and terminal fittings (15) held in the housing main body (10) while being passed through the opening (31). The reinforcing plate (30) is beveled along a peripheral edge thereof to form an R-surface (36). Thus, the device connector is produced at a low cost and eliminates possible starting points of cracks created in the synthetic resin covering the peripheral edge of the metal reinforcing plate (30).

16 Claims, 12 Drawing Sheets

DEVICE CONNECTOR

BACKGROUND OF THE INVENTION

1. Field of the Invention

The invention relates to a connector to be mounted in a case of a device.

2. Description of the Related Art

U.S. Pat. No. 7,572,150 discloses a device connector for connecting a wire-side connector mounted on an end of a wire extending from a power supply with a device such as a motor housed in a metal case in an electric vehicle. This device connector includes a housing made of synthetic resin and formed by insert molding using terminal fittings as inserts. The housing is mounted in an aluminum die-cast shell. The device connector is mounted in a device by bolt-fastening mount pieces provided on the die-cast shell.

The aluminum die-cast shell of the conventional device connector is strong but costly. Studies in recent years have tried to develop a sufficiently strong cost efficient device connector by molding a resin housing with a metal reinforcing plate as an insert. However, the synthetic resin shrinks more than the reinforcing plate in a cooling process after insert molding due to differences in the coefficients of thermal expansion of the synthetic resin and the metal reinforcing plate. Thus, the synthetic resin covering an outer peripheral edge of the reinforcing plate is pulled by the synthetic resin covering the opposite surfaces of the reinforcing plate. The synthetic resin covering the reinforcing plate is likely to be caught by a corner of the peripheral edge of the reinforcing plate and cracked with this caught part as a starting point.

The cracked synthetic resin makes the connector look poor and creates a clearance due to a reduction in adhesion of interfaces of the reinforcing plate and the synthetic resin, and water might enter the connector through this clearance.

In view of the above, it has been considered impractical to mold large connectors of synthetic resin with a metal reinforcing plate as an insert.

The invention was completed in view of the above and an object of the invention is to provide a cost efficient device connector while preventing a crack from being created.

SUMMARY OF THE INVENTION

The invention relates to a device connector to be mounted to a connector mounting portion in a case of a device. The device connector has a reinforcing plate with at least one device mounting portion to fix the device connector in the connector mounting portion and at least one opening for receiving terminal fittings. The device connector also has a housing formed by insert molding so that synthetic resin at least partly covers opposite surfaces of the reinforcing plate and a peripheral edge of the reinforcing plate. The terminal fittings can be held in the housing while being passed through the opening. The reinforcing plate is beveled at least partly along the peripheral edge.

The reinforcing plate preferably is made of metal.

The synthetic resin layers that cover the opposite surfaces of the reinforcing plate shrink to a large extent to pull the peripheral edges of the reinforcing plate when the housing is cooled in a mold. However, corners of the peripheral edge of the reinforcing plate are beveled. Thus, the synthetic resin covering the peripheral edge of the reinforcing plate has no corner that might be caught. Hence, there is no position which might become a starting point of a crack, and a crack in the synthetic resin can be prevented.

The peripheral edge of the reinforcing plate preferably is beveled to have an R-surface. Hence, the peripheral edge of the reinforcing plate is smooth. Even if the synthetic resin on the peripheral edge of the reinforcing plate is pulled by the synthetic resin on the opposite surfaces of the reinforcing plate, there is no corner that might catch the synthetic resin on the peripheral edge of the reinforcing plate. Therefore a crack in the synthetic resin can be prevented more reliably.

A part of the reinforcing plate covered by the synthetic resin of the housing may have one or more resin entrance holes. The synthetic resin that covers the reinforcing plate enters the resin entrance holes to connect layers of the synthetic resin on the opposite surfaces of the reinforcing plate and to adhere to the reinforcing plate, thereby weakening a pulling force on the synthetic resin covering the peripheral edge of the reinforcing plate. Therefore, a crack in the synthetic resin can be prevented.

Peripheral edges of the resin entrance holes preferably are beveled. As a result, there is no corner to catch the synthetic resin covering the resin entrance holes, similar to the peripheral edge of the reinforcing plate. Therefore, there is no position that might become a starting point of a crack and a crack in the synthetic resin can be prevented.

A part of the reinforcing plate covered by the synthetic resin of the housing may be formed with one or more anchor grooves. The synthetic resin that covers the reinforcing plate enters the anchor grooves, thereby weakening a pulling force on the synthetic resin covering the peripheral edge of the reinforcing plate. Therefore, a crack in the synthetic resin can be prevented.

The mounting portions preferably comprise bolt insertion holes formed in one or more mounting pieces projecting from the outer periphery of the reinforcing plate and at least partly exposed from the synthetic resin. Thus, it is possible to increase spacings between the terminal fittings and easily change the positions of the terminal fittings by increasing the opening for permitting the passage of the terminal fittings.

These and other objects, features and advantages of the invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
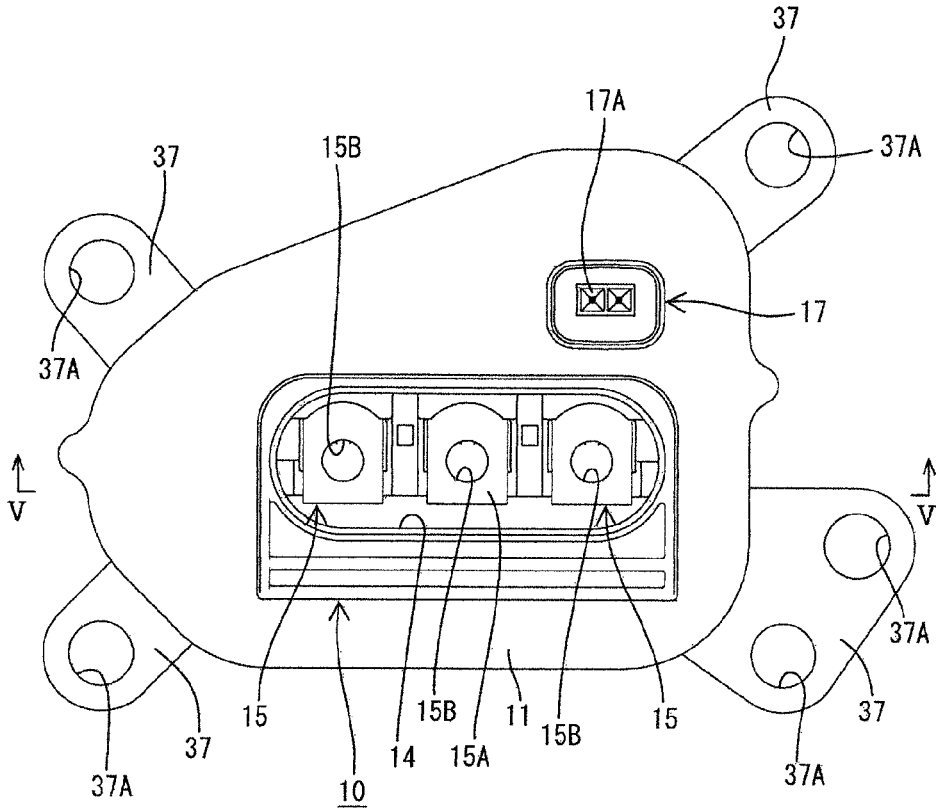
FIG. 1 is a front view of a device connector according to a first embodiment of the invention.
Figure 2:
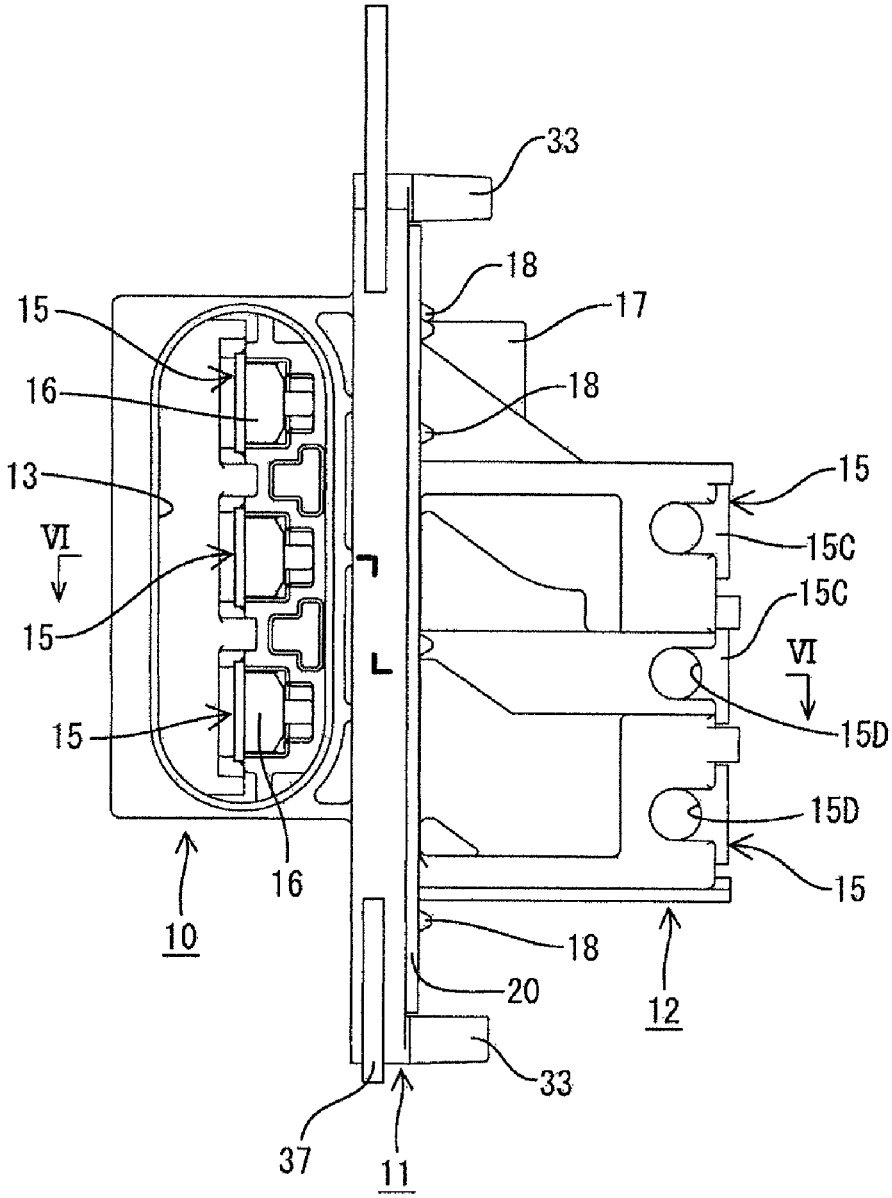
FIG. 2 is a plan view of the device connector.
Figure 3:
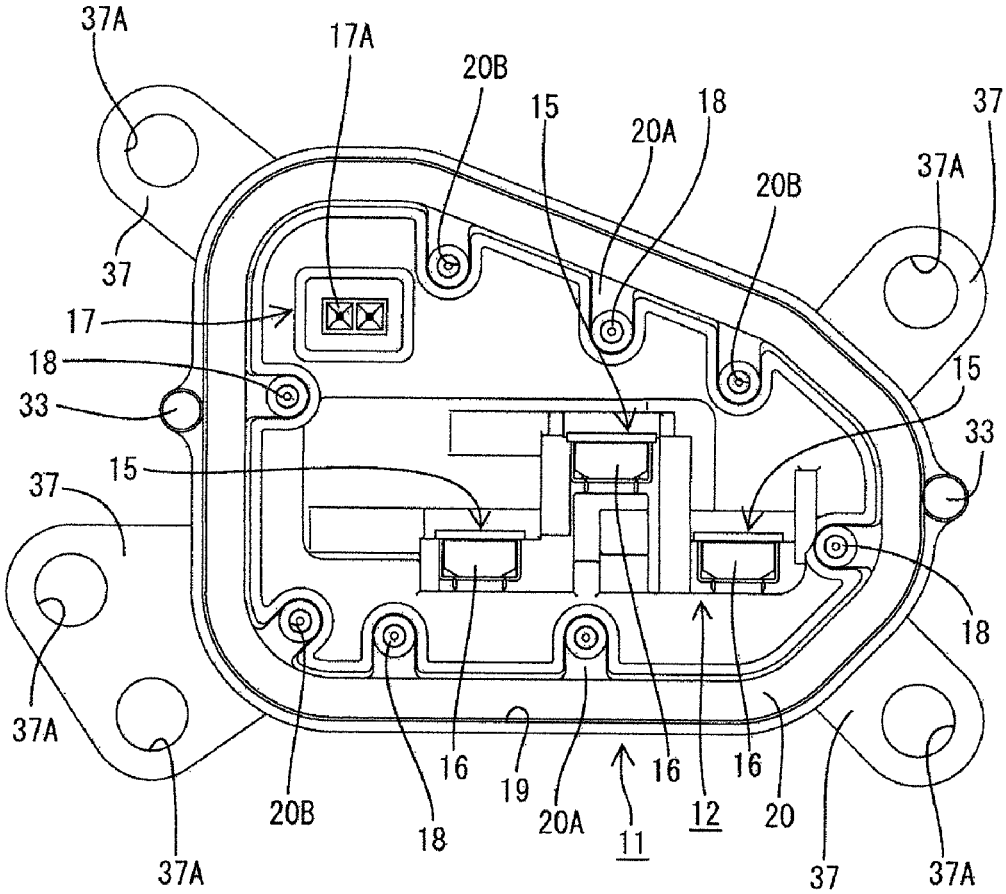
FIG. 3 is a rear view of the device connector.
Figure 4:
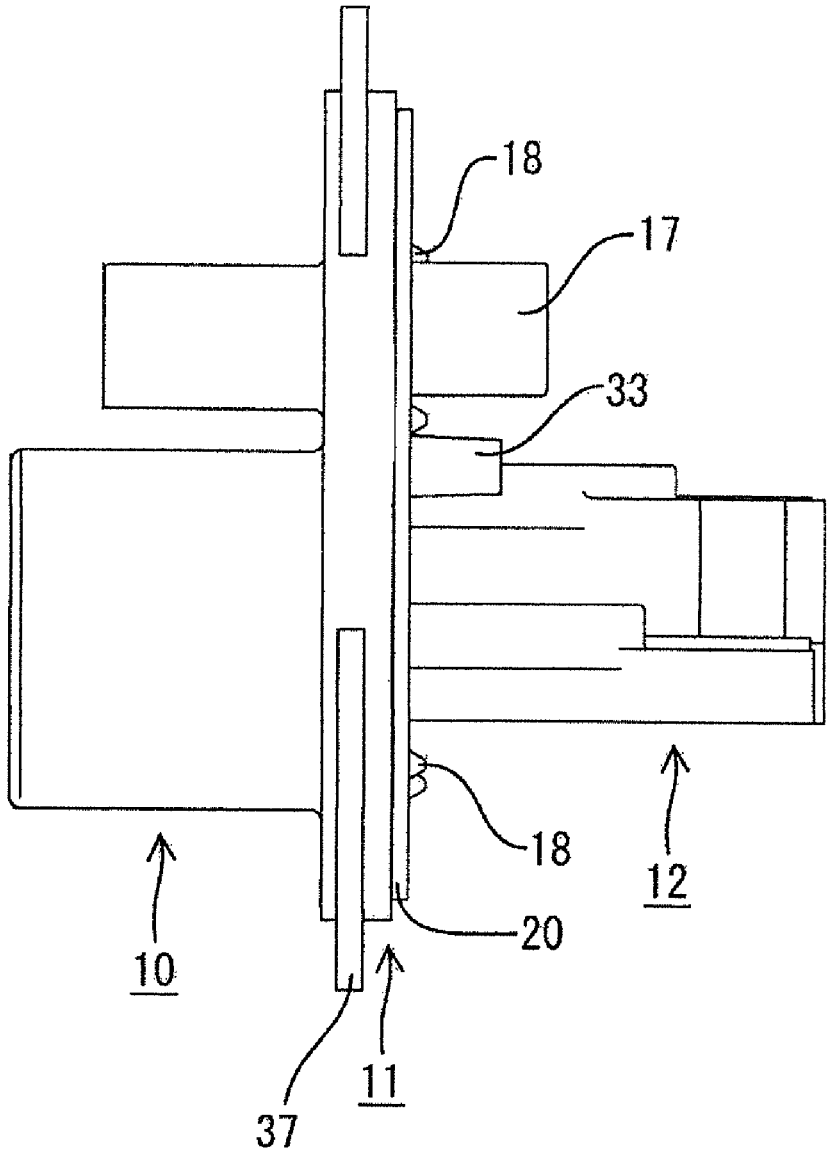
FIG. 4 is a side view of the device connector.
Figure 5:
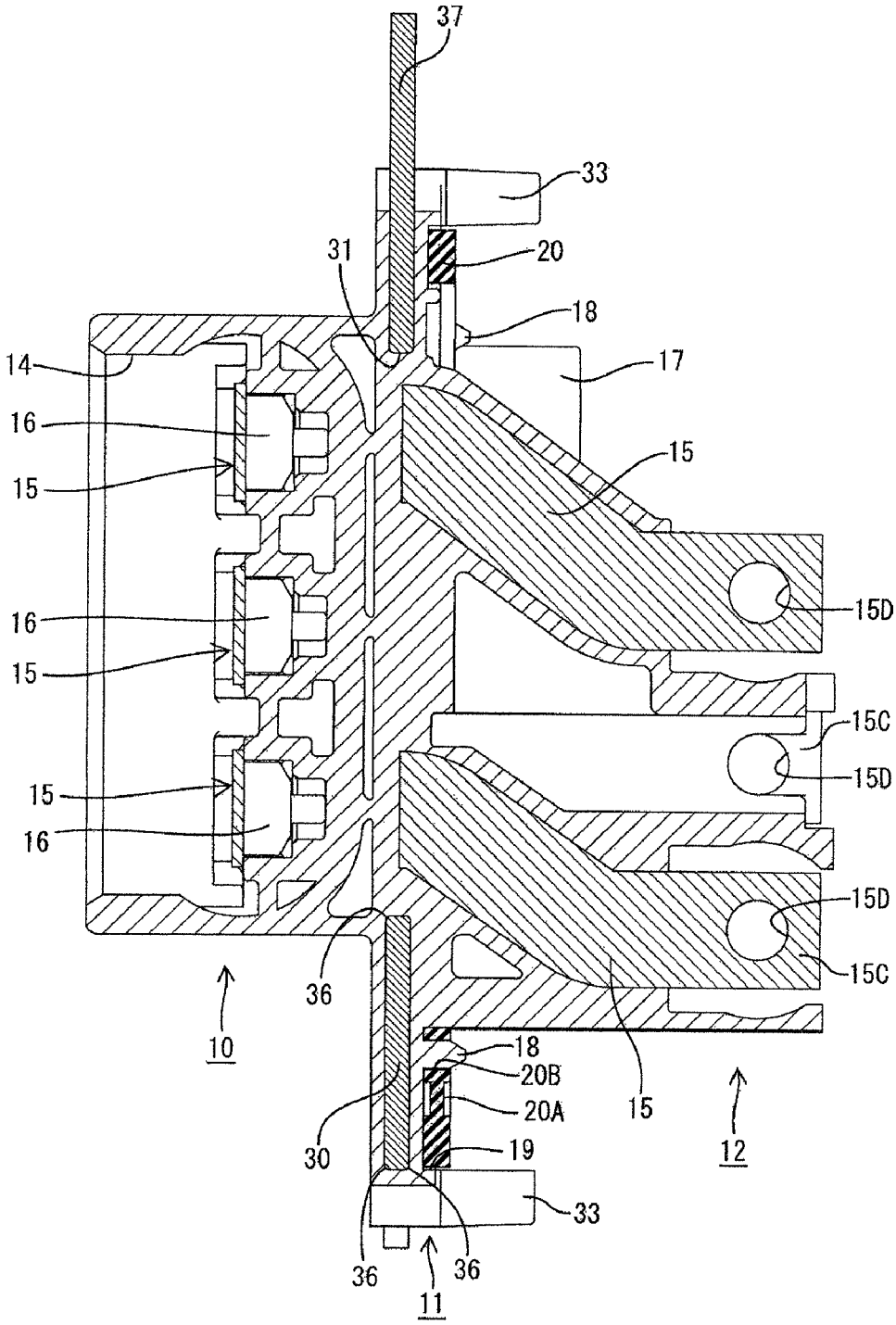
FIG. 5 is a section along V-V of FIG. 1.
Figure 6:
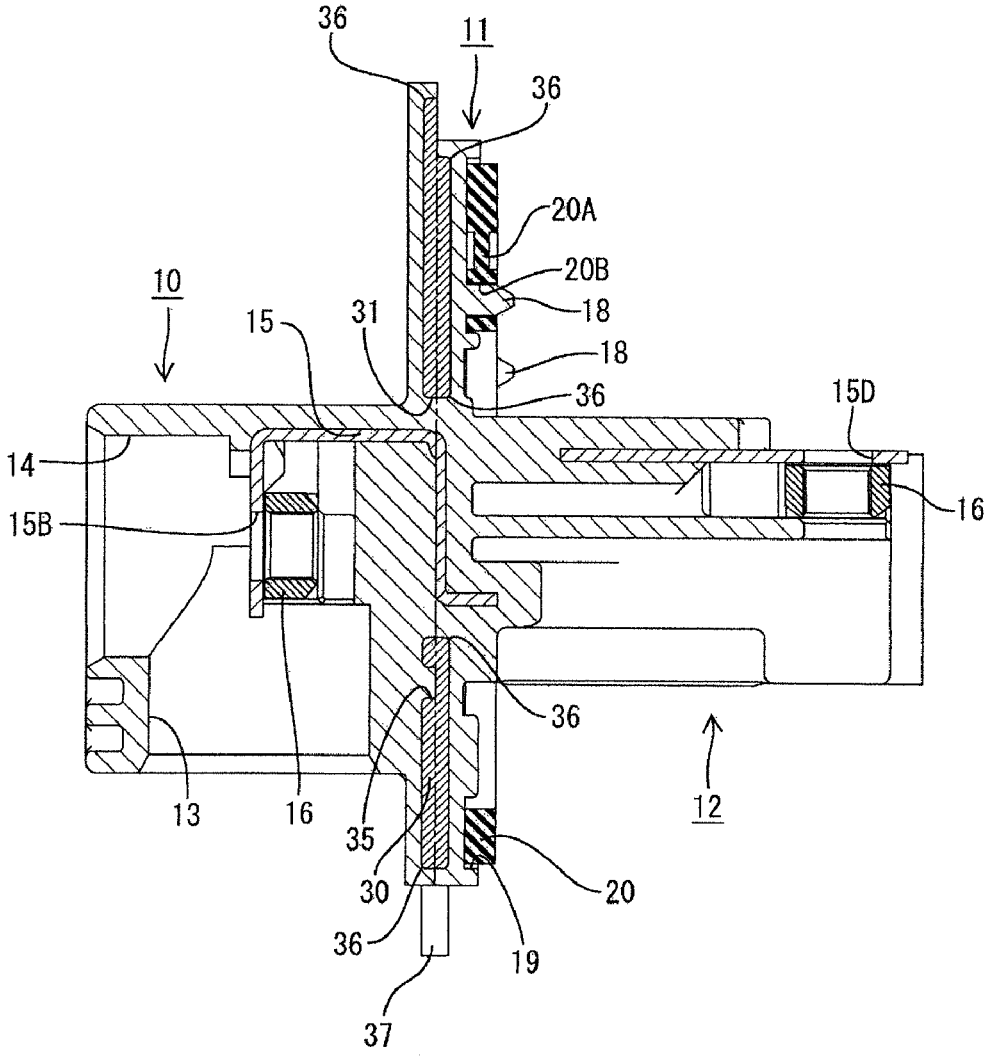
FIG. 6 is a section along VI-VI of FIG. 2.
Figure 7:
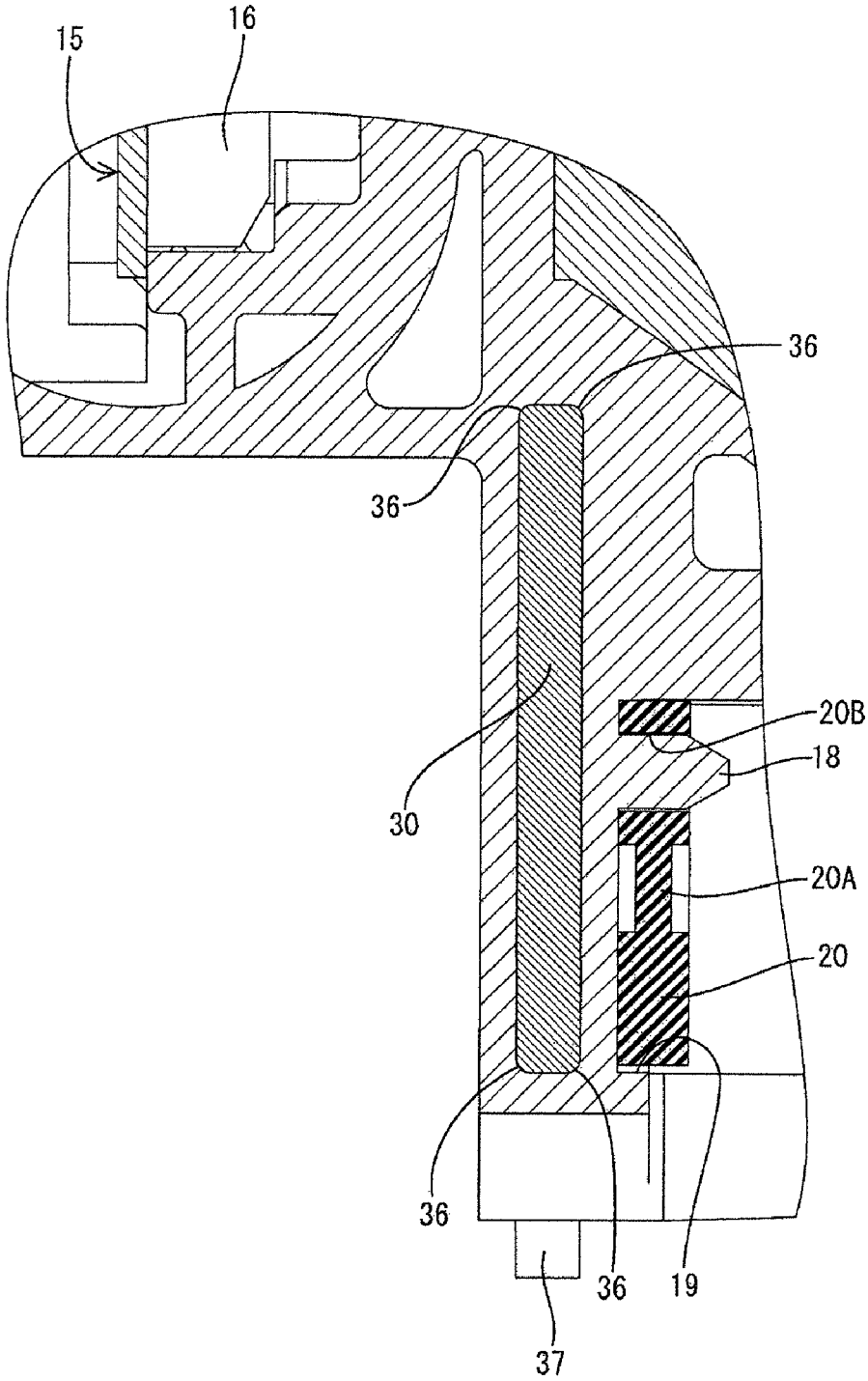
FIG. 7 is an enlarged section of a reinforcing plate showing a state after insert molding.

A device connector in accordance with a first embodiment of the invention is shown in FIGS. 1 to 7. The device connector is to be mounted in a connector mounting portion (not shown) in a case of a device. An end toward a mating connector and an end toward the connector mounting portion in the case of the device are referred to respectively as front and rear ends in the following description of the device connector. The device connector of the first embodiment has a housing main body 10 substantially in the form of a rectangular parallelepiped extending in a forward direction. A flange 11 extends out substantially normal to the forward direction from the outer peripheral surface of a rear part of the housing main body 10. A device-side housing portion 12 extends back from the rear surface of the flange 11 and is accommodated into a connector mounting hole (not shown) formed e.g. in the case of the device. The housing main body 10, the flange 11 and the device-side housing portion 12 shown here correspond to a connector housing made of synthetic resin.

The housing main body 10 has a fitting portion 13 and a work hole 14. The fitting portion 13 is formed in a side surface of the housing main body 10 substantially extending in a longitudinal direction and wire-side connectors (not shown) mounted on ends of wires can be fit in the fitting portion 13. The work hole 14 is formed in a projecting end surface of the housing main body 10. Terminal fittings 15 are held side by side at stages in the housing main body 10 and have opposite ends extending respectively to the device-side housing portion 12 and toward the fitting portion 13. A wire-side connecting portion 15A is formed in a leading end of each terminal fitting 15 and includes a first bolt hole 15B to be connected to a terminal (not shown) of the wire-side connector. A first nut 16 is mounted in the housing main body 10 on a surface of each wire-side connecting portion 15A facing toward the flange 11 and is substantially continuous with the first bolt hole 15B so that bolt connection can be carried out through the work hole 14.

The flange 11 is unitary with a reinforcing plate 30 that is made of a stiff material, such as metal, having a sufficient mechanical strength. More particularly, the reinforcing plate 30 is used as the insert in an insert molding process so that at least parts of the opposite surfaces of the reinforcing plate 30 are surrounded by and integral to a unitary matrix of synthetic resin.

Figure 8:
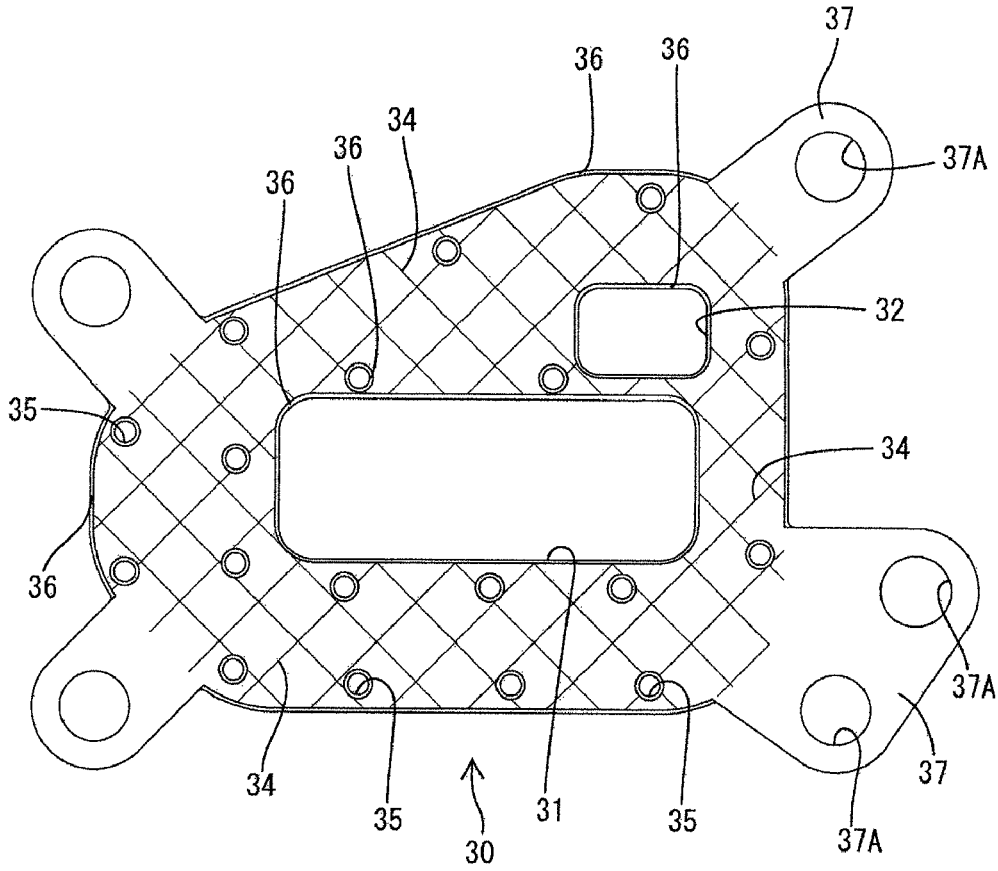
FIG. 8 is a front view of the reinforcing plate showing a state before insert molding.

The reinforcing plate 30 is punched out by a press to define a substantially trapezoidal shape with an one opening 31 for permitting passage of the terminal fittings 15 and an auxiliary opening 32 for permitting passage of a connection detecting terminal, as shown in FIG. 8. The opening 31 has a substantially rectangular shape extending in the longitudinal direction and is in a substantially central part of the reinforcing plate 30. The auxiliary opening 32 is near the opening 31 and near one shorter side of the reinforcing plate 30. The auxiliary opening 32 is substantially rectangular shape and is less than about half (e.g. about ⅓) as wide as the opening 31. The terminal fittings 15 held in the device connector connect the housing main body 10 and the device-side housing portion 12 through the opening 31.

The device-side housing portion 12, positioning pins 33, an auxiliary housing 17 and protruberances 18 are formed on the rear surface of the flange 11. The device-side housing portion 12 extends substantially straight back at a position slightly laterally shifted from the housing main body 10. The positioning pins 33 are used for mounting the device connector in the case (not shown) of the device. The auxiliary housing 17 extends back at a position offset from the device-side housing portion 12 and the protuberances 18 from an outer peripheral edge of the flange 11 or from a mounting groove 19 looped along the outer peripheral edge of the flange 11.

The terminal fittings 15 connecting the housing main body 10 and the device-side housing portion 12 are held in a bent state in the device-side housing portion 12 due to a positional relationship of the housing main body 10 and the device-side housing portion 12.

The protuberances 18 are formed at spaced apart positions located slightly inward of the outer peripheral edge of the flange 11 and have projecting ends that are tapered. The mounting groove 19 is located outside the protuberances 18 and a sealing member 20 is mounted therein. The sealing member 20 has flange-side mounting portions 20A, each of which includes at least one mounting hole 20B at a position substantially corresponding to the protuberance 18. The device-side connector mounts the sealing member 20 into the mounting groove 19 of the flange 11 by inserting the protuberances 18 of the flange 11 into the mounting holes 20B of the sealing member 20.

In the device-side housing portion 12, the terminal fittings 15 extending back from the flange 11 are held or positioned in a substantially isosceles triangle arrangement, and device-side connecting portions 15C are formed in leading end portions. Each device-side connecting portion 15C includes a second bolt hole 15D and can be bolt-connected to a device-side terminal (not shown). Nuts 16 substantially continuous with the respective second bolt holes 15D are mounted in the device-side housing portion 12.

The positioning pins 33 are in the form of cylinders slightly tapered toward the back at two positions of opposite end portions of the flange 11.

The auxiliary housing 17 also substantially extends forward via the flange portion 11, and a connection detecting terminal 17A passed through the auxiliary opening 32 of the flange 11 is held in the auxiliary housing 17.

Net-like anchor grooves 34 are formed in the opposite surfaces of the reinforcing plate 30 to be covered by the synthetic resin and resin entrance holes 35 penetrate through the reinforcing plate 30. The inner peripheral edge of the opening 31, the inner peripheral edge of the auxiliary opening 32 and/or the outer peripheral edge of the reinforcing plate 30 are beveled, chamfered, slanted, sloped tapered or rounded to have R surfaces 36 (i.e. a surface having a circular bend between the two adjacent surfaces, e.g. between a horizontal surface and an adjacent vertical surface of the reinforcing plate 30).

Mounting pieces 37 extend from the reinforcing plate 30 at four outer corners of the outer periphery of the flange 11. The mounting pieces 37 are exposed from the synthetic resin and including bolt insertion holes 37A.

The device connector of this embodiment is constructed as described above. Here is described a shrinkage deformation when the synthetic resin member is cured during insert molding.

The synthetic resin portions covering the reinforcing plate 30 of the device connector shrink more than the metal reinforcing plate 30 device-side connecting portions 15C because of their different coefficients of thermal expansion when cured by cooling during insert molding. Thus, the synthetic resin covering the peripheral edge of the reinforcing plate 30 is pulled by the synthetic resin covering the opposite surfaces of the reinforcing plate 30. However, all of the peripheral edge portions of the reinforcing plate 30 are beveled, chamfered, slanted, sloped, tapered or rounded and have the smoothly machined R-surfaces 36. Thus, even if the synthetic resin on the beveled portions (particularly R-surfaces 36) is pulled from the opposite sides, cracks are be prevented since there is no corner that might become a starting point of the crack.

Next, a second preferred embodiment of the present invention is described with reference to FIGS. 9 to 12.

Figure 9:
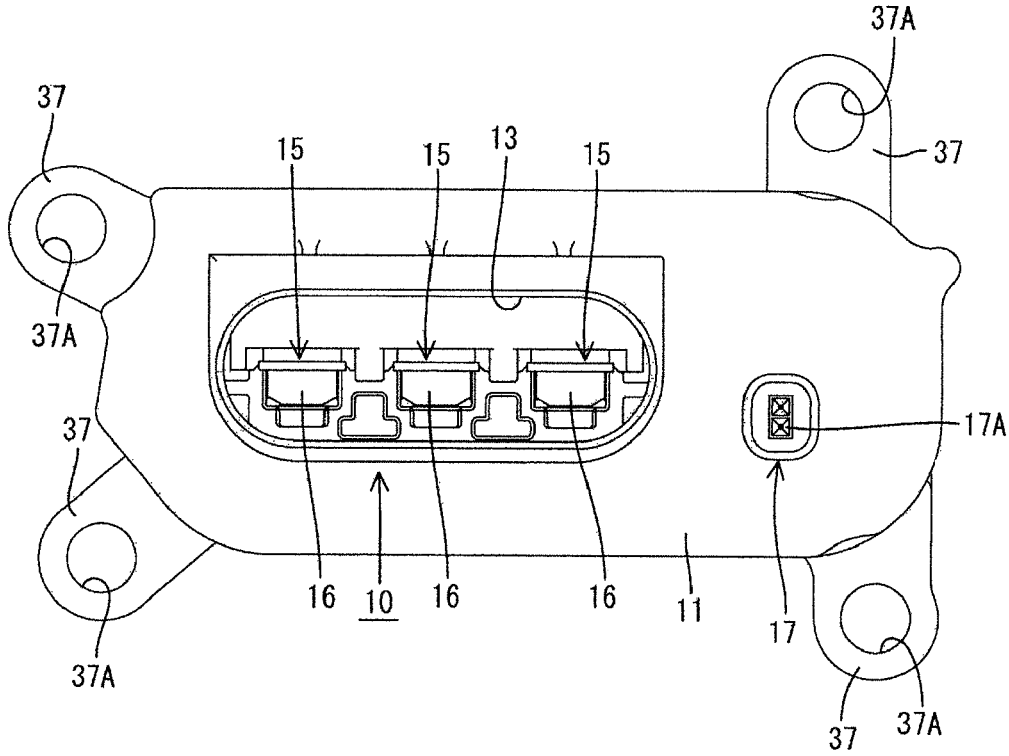
FIG. 9 is a front view of a device connector according to a second embodiment of the invention.
Figure 10:
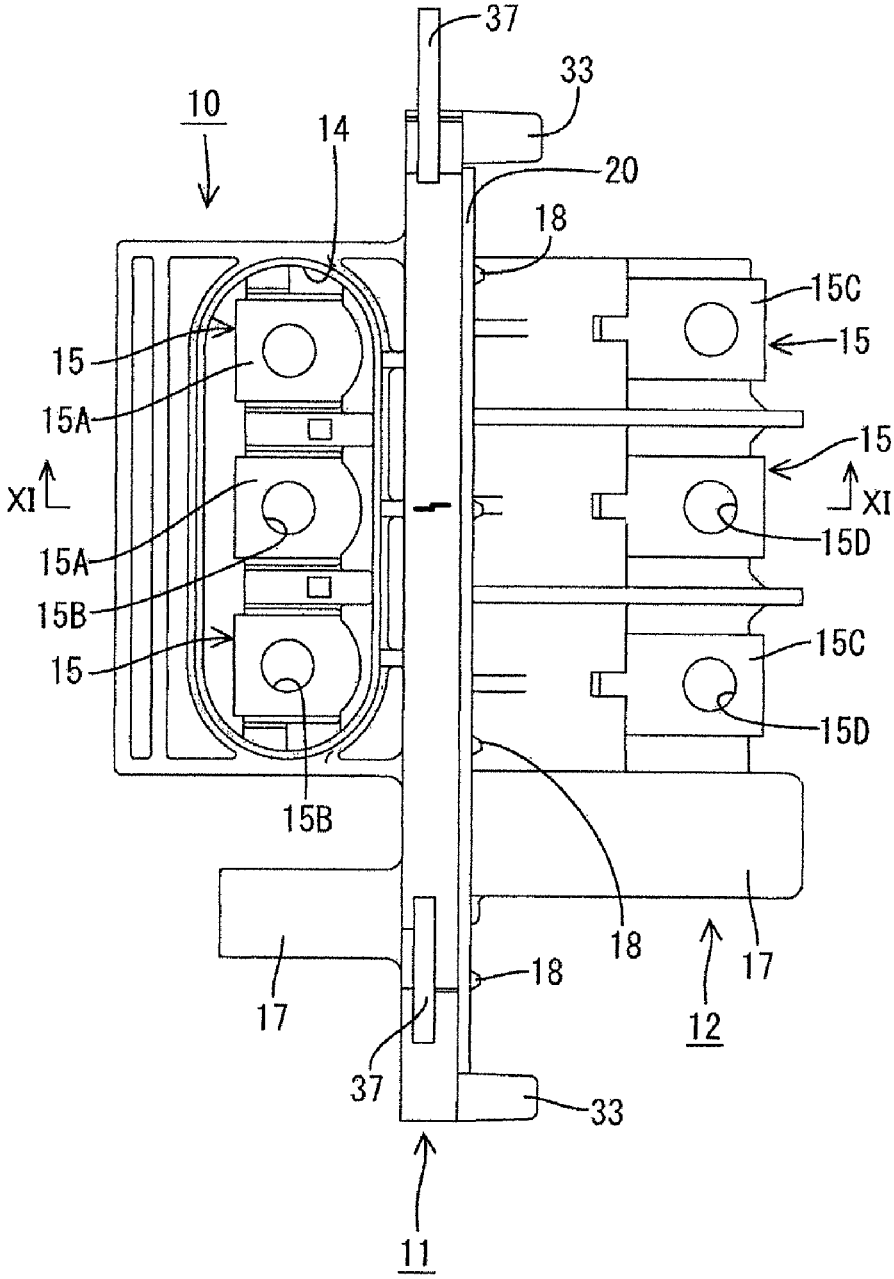
FIG. 10 is a plan view of the device connector.
Figure 11:
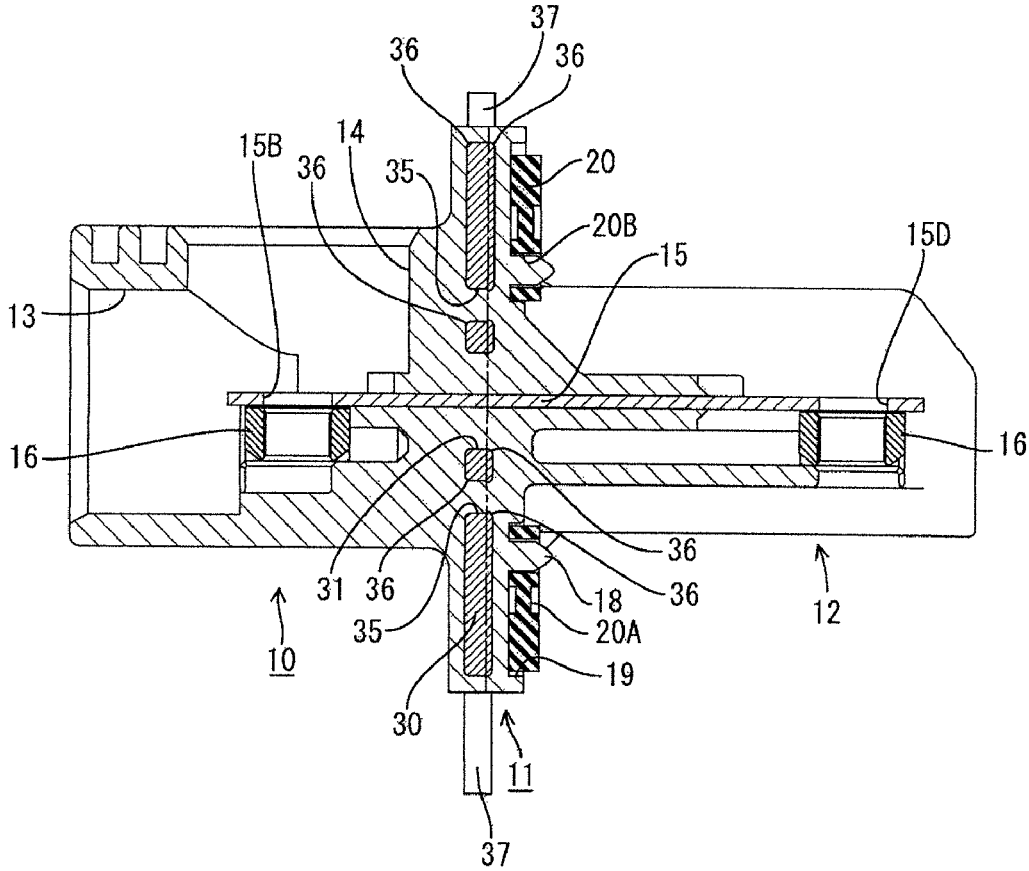
FIG. 11 is a section along XI-XI of FIG. 10.
Figure 12:
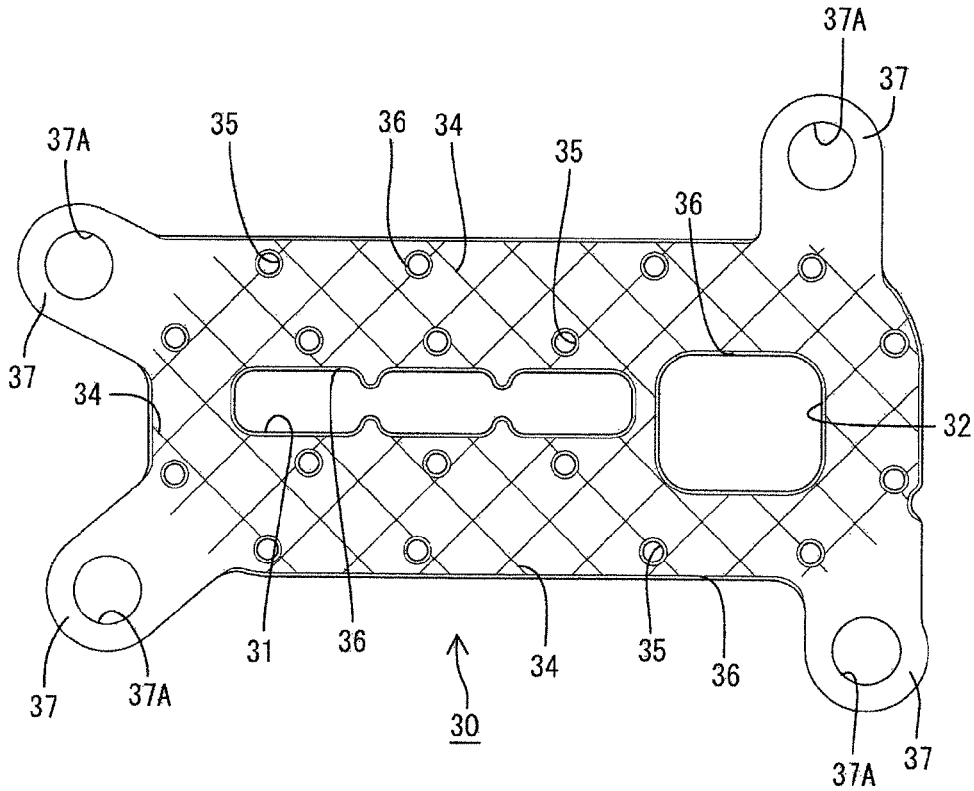
FIG. 12 is a front view of a reinforcing plate showing a state before insert molding.

A device connector of the second embodiment is mounted in a connector mounting portion (not shown) in a case of a device similar to the first embodiment. As shown in FIGS. 9 to 11, a flange 11 has a substantially rectangular shape and a device-side housing portion 12 is formed adjacent to and behind a housing main body 10. Further, the positions of at least one fitting 13 and at least one work hole 14 are switched in the housing main body 10, and terminal fittings 15 are held inside to extend straight back.

Terminal fittings 15 are held side by side in the device-side housing portion 12. Thus, the terminal fittings 15 connecting the housing main body 10 and the device-side housing portion 12 extend substantially on the same plane, although being slightly bent in the device-side housing portion 12.

An auxiliary housing 17 extends in forward and backward directions via the flange 11 such that surfaces of the auxiliary housing 17 before and after the flange 11 are shifted laterally somewhat, and a connection detecting terminal 17A in the auxiliary housing 17 accordingly also is bent in the auxiliary housing 17.

A substantially rectangular reinforcing plate 30 is in the flange 11. A narrow generally rectangular opening 31 is formed in a substantially central position of the reinforcing plate 30 for permitting the passage of the terminal fittings. Further, an auxiliary opening 32 is formed laterally adjacent to the opening 31. The other construction is similar or substantially same as in the first embodiment.

Similar to the first embodiment, in the second embodiment, the opposite surfaces of the reinforcing plate 30 are at least partly covered by synthetic resin and a synthetic resin portion located at a peripheral edge portion of the flange portion 11 is pulled by the synthetic resin located on the opposite surfaces of the reinforcing plate 30 because of a relationship concerning a coefficient of thermal expansion in a cooling process after insert molding. However, all of the peripheral edges of the reinforcing plate 30 are beveled to define smoothly machined R-surfaces 36. Thus, cracks are not formed even if the synthetic resin on the R-surfaces 36 is pulled from the opposite sides because there is no corner that might become a starting point of the crack.

The invention is not limited to the above described and illustrated embodiments. For example, the following embodiments are also included in the scope of the invention.

Although the opening 31 for permitting the passage of the terminal fittings is a loop hole formed by the closed inner peripheral edge of the reinforcing plate 30 in the above embodiments, the present invention is not limited to such a mode and the opening 31 may be an opening in an open state.

Although the terminal fittings 15 are connected by the bolts in the above embodiments, the present invention is not limited to such a mode and they may be, for example, male terminal fittings to be connected to female terminal fittings provided in the wire-side connector.

Although the peripheral edge portions of the reinforcing plate 30 are beveled to have the R-surfaces in the above embodiment, the present invention is not limited to such a mode and the peripheral edge portions may be, for example, tapered.

Although the net-like anchor grooves 34 are formed in the opposite surfaces of the reinforcing plate 30 in the above embodiments, the present invention is not limited to such a mode and, for example, anchor grooves may be formed in stripes or broken lines or no anchor grooves may be formed in the opposite surfaces of the reinforcing plate 30.

Although the reinforcing plate 30 is formed with the resin entrance holes 35 in the above embodiments, the present invention is not limited to such a mode and, for example, no resin entrance holes may be formed in the reinforcing plate 30.

What is claimed is:

1. A device connector to be mounted in a connector mounting portion provided in a case of a device, comprising:

at least one reinforcing plate including at least one device mounting portion used to fix the device connector in the connector mounting portion and at least one opening;

a housing formed by insert molding such that synthetic resin at least partly covers opposite surfaces of the reinforcing plate and a peripheral edge of the reinforcing plate; and terminal fittings held in the housing while passing through the opening;

wherein the reinforcing plate is beveled at least partly along a peripheral edge portion thereof.

2. The device connector of claim 1, wherein the peripheral edge portion of the reinforcing plate is beveled to have an R-surface.

3. The device connector of claim 1, wherein at least one resin entrance hole penetrates the reinforcing plate and the synthetic resin enters the resin entrance hole for connecting areas of the resin on opposite surfaces of the reinforcing plate.

4. The device connector claim 3, wherein peripheral edge portions of the resin entrance hole are at least partly beveled.

5. The device connector of claim 1, wherein the reinforcing plate is formed with at least one anchor groove and the synthetic resin enters the anchor groove.

6. The device connector of claim 1, wherein the mounting portions comprise bolt insertion holes formed in mounting pieces projecting from the outer periphery of the reinforcing plate and at least partly exposed from the synthetic resin.

7. A device connector, comprising:

a unitary housing formed of synthetic resin having a first coefficient of thermal expansion;

terminal fittings having intermediate portions insert molded into the synthetic resin of the housing so that the intermediate portions are engaged by the synthetic resin of the housing;

a metal reinforcing plate having a second coefficient of thermal expansion different from the first coefficient of thermal expansion, the reinforcing plate having opposite first and second surfaces and an outer peripheral edge, the reinforcing plate being insert molded into the synthetic resin of the housing so that at least parts of the outer peripheral edge and at least parts of the opposite first and second surfaces are engaged by the synthetic resin of the housing, the outer peripheral edge being beveled and free of corners to avoid damaging the synthetic resin due to dimensional changes caused by the different coefficients of thermal expansion.

8. The device connector of claim 7, wherein the reinforcing plate has at least one opening, the terminal fittings passing through the opening.

9. The device connector of claim 8, wherein the opening has an inner peripheral edge beveled and free of corners, the synthetic resin of the housing engaging the beveled inner peripheral edge of the opening.

10. The device connector of claim 7, wherein the reinforcing plate has device mounting portions projecting at the outer peripheral edge for fixing the device connector to a device.

11. The device connector of claim 10, wherein the mounting portions comprise bolt insertion holes formed in mounting pieces projecting from the outer peripheral of the reinforcing plate and at least partly exposed from the synthetic resin.

12. The device connector of claim 7, wherein resin entrance holes penetrate the reinforcing plate and the synthetic resin extends unitarily through the resin entrance holes for connecting areas of the resin on the opposite surfaces of the reinforcing plate.

13. The device connector claim 12, wherein peripheral edge portions of the resin entrance holes are beveled.

14. The device connector of claim 13, wherein the reinforcing plate has at least one opening, the terminal fittings passing through the opening, the opening having an inner peripheral edge beveled and free of corners, the synthetic resin of the housing engaging the beveled inner peripheral edge of the opening.

15. The device connector of claim 7, wherein at least one anchor groove is formed in at least one of the opposite surfaces of the reinforcing plate and the synthetic resin being in the anchor groove.

16. The device connector of claim 7, wherein each of the terminal fittings has opposite connecting portions exposed from the synthetic resin of the housing.

* * * * *